US007640942B2

(12) United States Patent
Chu

(10) Patent No.: US 7,640,942 B2
(45) Date of Patent: Jan. 5, 2010

(54) AIR-PERMEABLE SIMPLE CAR COVER TENT

(75) Inventor: I-Tung Chu, 5F, No. 130, Sec. 1, Chenggong Rd., Yonghe City, Taipei County (TW)

(73) Assignees: Sportsman Corp., Taipei County (TW); I-Tung Chu, Taipei County (TW)

( * ) Notice: Subject to any disclaimer, the term of this patent is extended or adjusted under 35 U.S.C. 154(b) by 0 days.

(21) Appl. No.: 12/165,138

(22) Filed: Jun. 30, 2008

(65) Prior Publication Data

US 2009/0188541 A1 Jul. 30, 2009

(30) Foreign Application Priority Data

Jan. 28, 2008 (TW) ..... 97201766 U

(51) Int. Cl.
*E04H 15/36* (2006.01)
*E04H 15/44* (2006.01)

(52) U.S. Cl. ..... 135/132; 135/146

(58) Field of Classification Search ..... 135/93, 135/124, 125, 126, 128, 129, 132, 133, 137, 135/138, 147, 148, 117, 88.13, 88.01
See application file for complete search history.

(56) References Cited

U.S. PATENT DOCUMENTS 1,097,941 A * 5/1914 Rector ..... 5/129
2,230,454 A * 2/1941 Friesner et al. ..... 135/117
2,960,993 A * 11/1960 Holmstrom ..... 135/130
3,171,417 A * 3/1965 Stokes ..... 135/132

* cited by examiner

*Primary Examiner*—David Dunn
*Assistant Examiner*—Danielle Jackson
(74) *Attorney, Agent, or Firm*—Muncy, Geissler, Olds & Lowe, PLLC

(57) ABSTRACT

An air-permeable simple car cover tent is formed by covering a cover onto a plurality of supports and a base. One end of the cover is provided with a falling part, two holes, and at least an air window. The top of the falling part is connected with the cover. The base is provided with a first and a second lateral plate that are parallel to each other and connected to the bottoms of a first and a second support legs and each support, so that each support is movable on the base. The tops of the first and the second support legs are inserted into the holes of the cover and connected to the bottom of the falling part to prop the falling part open and air can flow through the cover.

6 Claims, 8 Drawing Sheets

AIR-PERMEABLE SIMPLE CAR COVER TENT

BACKGROUND OF THE INVENTION

1. Field of the Invention

The present invention relates to a car cover tent and, more particularly, to an air-permeable simple car cover tent suitable for parking two wheels motorcycles and air can flow through a cover by the synchronous action of a first and second support legs protruding out of the cover and a falling part connected to the cover.

2. Description of the Prior Art

Conventional automobile covers are spread directly onto various automobiles. In order to keep the covers from being blown away from automobiles, some covers are provided with small holes near the bottom thereof, through which fasten belts or cords can be inserted and fastened to tires or the bottom of automobiles. However, when automobiles are protected by covers and parked under burning sun, heat is easy to be transferred to automobiles via covers because the distance between the automobiles and the covers is not sufficient to prevent the heat transfer. Besides, covers may easily rub against the automobiles under the covers when the covers under a fierce wind. Moreover, it may be difficult to use automobile covers when automobiles are parked outside in rainy days or when exhaust pipes of the automobiles are still at high temperature.

The problems mentioned above also may be true for motorcycles. Therefore, a fixed simple car cover tent is formed by covering an outer cover onto a plurality of supports to solve the problems of using conventional automobile covers. Besides, the outer cover is provided with a window and air can flow freely through the cover. However, rain may be easily splashed into the outer cover through the window under a torrential rain and consequently it fails to protect a motorcycle covered therein. Besides, even if the outer is provided with no window in order to overcome the problem above, compartments of a motorcycle covered with the outer cover may be damaged easily deteriorated when in a sultry day.

In order to solve the problems mentioned above, inventor had the motive to study and develop the present invention after hard research to provide an air-permeable simple car cover tent that is rainproof and foldable. By using the simple car cover tent, the temperatures inside and outside the cover of the simple car cover tent can be regulated effectively.

SUMMARY OF THE INVENTION

An object of the present invention is to provide an air-permeable simple car cover tent with a cover provided with an air window and two support legs. By providing two support legs that protrudes from the inside to the outside of the cover to prop a falling part open, air can flow freely through the cover to prevent from high temperature inside the cover and the lifetime of a motorcycle parked therein can be extended consequently.

Another object of the present invention is to provide an air-permeable simple car cover tent, where a cover is covered onto a plurality of supports that are movable in relative to a base, so that the cover can be folded easily and is convenient for users.

In order to achieve the above object, the present invention provides an air-permeable simple car cover tent comprising a base, a plurality of supports, a first support leg and a second support leg, and a cover. The base includes a first lateral plate and a second plate which are parallel. Each support includes a first support bar and a second support bar that are parallel. The bottoms of the first and the second support bars are pivotally connected to the first and the second lateral plates respectively. The bottom of the first support is pivotally connected to the first lateral plate while the bottom of the second support is pivotally connected to the second lateral plate. One end of the cover is provided with a falling part, two holes and at least an air window. The top of the falling part is connected with the cover and the tops of the first and the second support legs are inserted through the holes respectively and connected to the bottom of the falling part to prop the falling part open and air can flow through the cover.

The following detailed description, given by way of examples or embodiments, will best be understood in conjunction with the accompanying drawings.

DETAILED DESCRIPTION OF THE PREFERRED EMBODIMENTS

Figure 1:
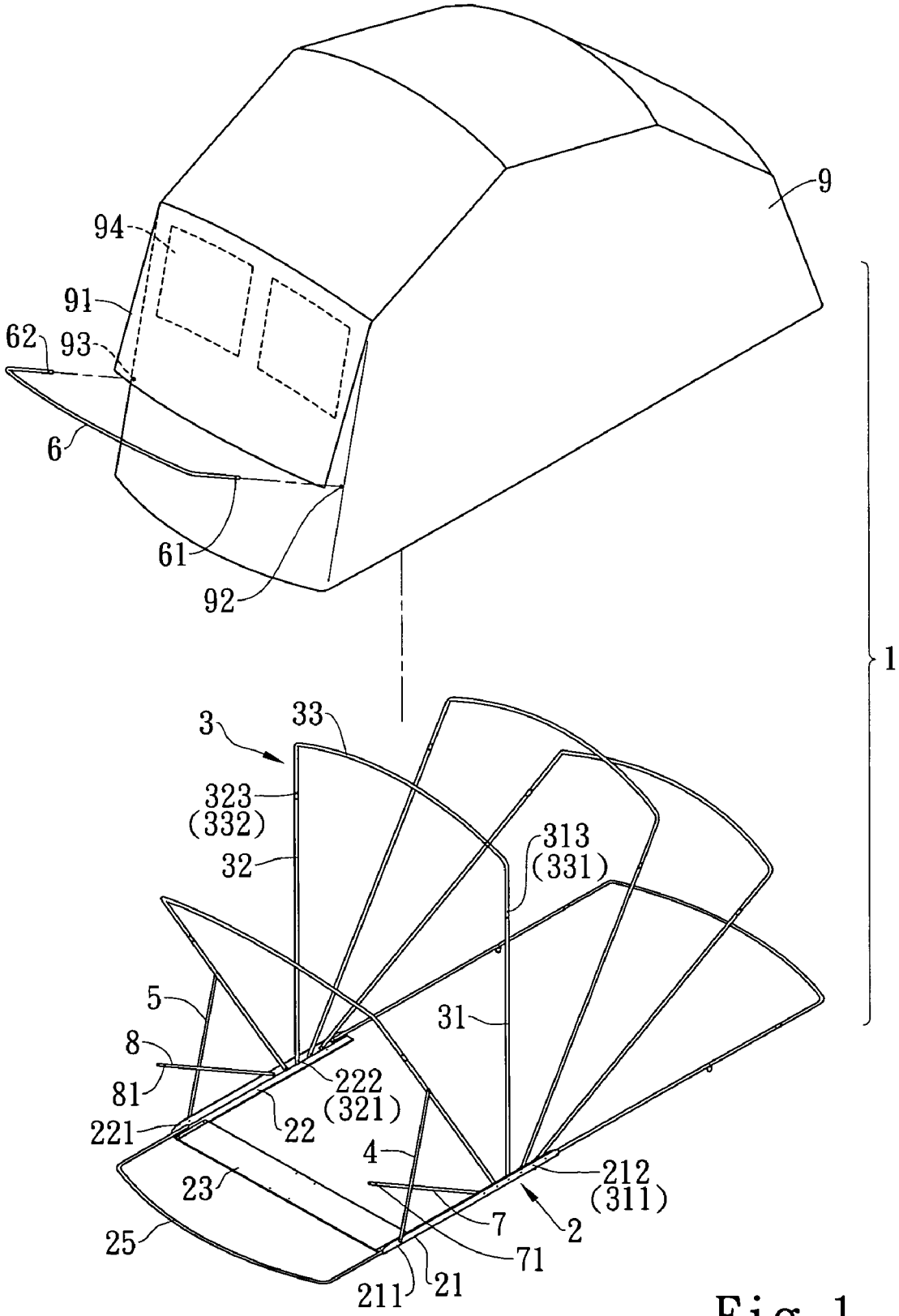
FIG. 1 shows a specific exploded perspective view of a preferred embodiment of the present invention.
Figure 2:
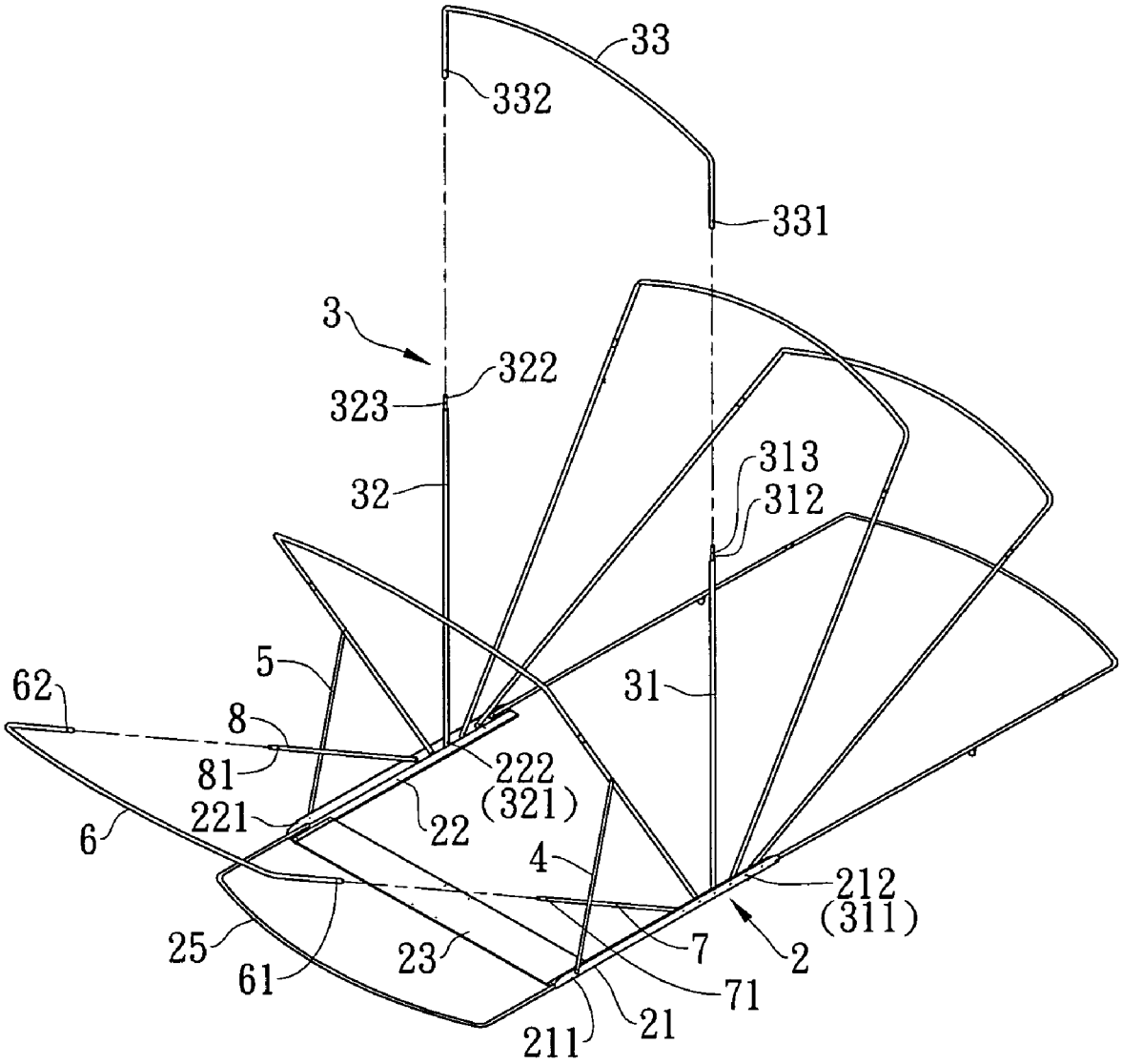
FIG. 2 shows another specific exploded perspective view of a preferred embodiment of the present invention.

Please refer to FIGS. 1 and 2 showing a preferred embodiment of an air-permeable simple car cover tent 1 according to the present invention. The air-permeable simple car cover tent 1 comprises a base 2, a plurality of supports 3, a first support post 4 and a second support post 5, an arched support leg 6, a first support leg 7, a second support leg 8, and a cover 9.

The base 2 includes a first lateral plate 21, a second lateral plate 22, a bottom plate 23, and a rear support 25. The first and the second lateral plates 21, 22 are parallel long plates and have L-shape cross-sections. The first lateral plate 21 has a upright plate 211 provided with a plurality of horizontally arranged round first holes 212 while the second lateral plate 22 has a upright plate 221 provided with a plurality of second holes 222 that correspond to the first holes 212. The bottom plate 23 is a long plate and has two ends connected with the rear ends of the first and the second lateral plates 21, 22 respectively. Thus, the bottom plate 23 together with the first and the second lateral plates 21, 22 form a U-shape combination. The rear support 25 is in U-shape and connected to the rear ends of the first and the second lateral plates 21, 22.

In this embodiment, there are five supports 3 and each support 3 includes a first support bar 31, a second support bar 32, and an arched support bar 33. The first support bar 31 and the second support bars 32 are parallel to each other and each bottom thereof is provided with a hole 311, 321. A pivot is inserted through the first and the second holes 212, 222 and the holes 311, 321 of the first and the second support bars 31, 32. Consequently, the first and the second support bars 31, 32 are movable in relative to the first and the second lateral plates 21, 22 of the base 2. Moreover, each top of the first and the second support bars 31, 32 is formed with a shrinkage tube 312, 322 and each shrinkage tube 312, 322 is provided with an elastic fastener 313, 323. The arched support bar 33 is in U-shape and formed by bending a round tube. Each end of the arched support bar 33 is provided with a positioning hole 331, 332 for connecting two ends of the arched support bar 33 onto the shrinkage tubes 312, 322 of the first and the second support bars 31, 32, where each elastic fastener 313, 323 is positioned into each positioning hole 331, 332.

The first and the second posts 4, 5 are long tubes and the bottoms thereof are connected with the first and the second lateral plates 21, 22 respectively. To support the support 3, the tops of the first and the second posts 4, 5 are connected respectively to the first and the second support bars 31, 32 of the support 3 that is nearest the rear ends of the first and the second lateral plates 21, 22 among five supports 3.

The arched support leg 6 is an inverse U-shape round tube and two end feet thereof are provided with a positioning hole 61, 62 respectively. The first and the second support legs 7, 8 are long tubes with a smaller diameter than that of each end foot and are provided with an elastic fastener 71, 81 respectively. When the first and the second support legs 7, 8 are inserted into the two feet of the arched support leg 6 respectively, each elastic fastener 71, 81 is located into one positioning hole 61, 62 of the arched support leg 6. Besides, the bottom of the first support leg 7 is pivotally connected to the upright plate 211 of the first lateral plate 21 while the bottom of the second support leg 8 is pivotally connected to the upright plate 221 of the second lateral plate 22.

The cover 9 is sewn by waterproof woven fabric and is provided with a falling part 91, two holes 92, 93, and two air windows 94 at its rear end. The falling part 91 is a rectangular piece of cloth and the top thereof is sewn to the upper part of the cover 9. The falling part 91 hangs down and covers the two air windows 94 and the bottom of the falling part 91 is connected with the arched support leg 6. Besides, the two holes 92, 93 are respectively provided at the left and the right sides of the rear end of the cover 9. The first and the second support legs 7, 8 are inserted through the holes 92, 93 and then connected to two feet of the arched support leg 6 respectively, so that the falling part 91 can be propped open. (As shown in FIG. 3)

Figure 3:
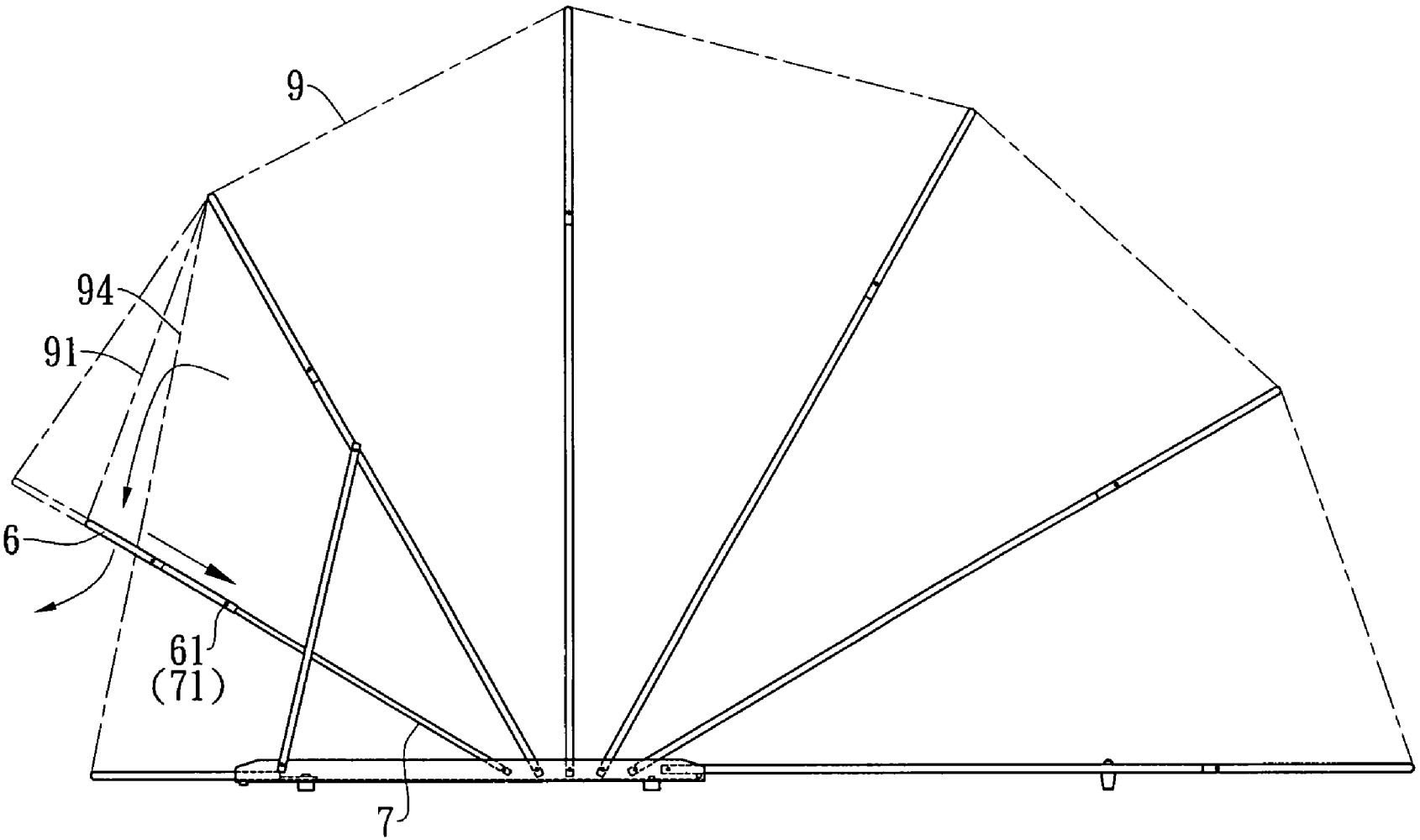
FIG. 3 shows a using state diagram showing an arched support leg of the present invention that corresponds to the first and the second support legs that are extended or shortened.

Please refer to FIG. 3 that shows a using state diagram of the present invention. When two feet of the arched support leg 6 slides upward along the first and the second support legs 7, 8, the falling part 91 can be propped open by the positioning action via the elastic fasteners 71, 81 of the first and the second support legs 7, 8. Consequently, a wilder space can be formed between the failing part 91 and the rear end of the cover 9 and air can flow freely through the two air windows 94 and the space. When the elastic fasteners 71, 81 are released, the arched support leg 6 will slide downward owing to the weight of the arched support leg 6 and the falling part 91 and cover the two air windows 94.

Figure 4:
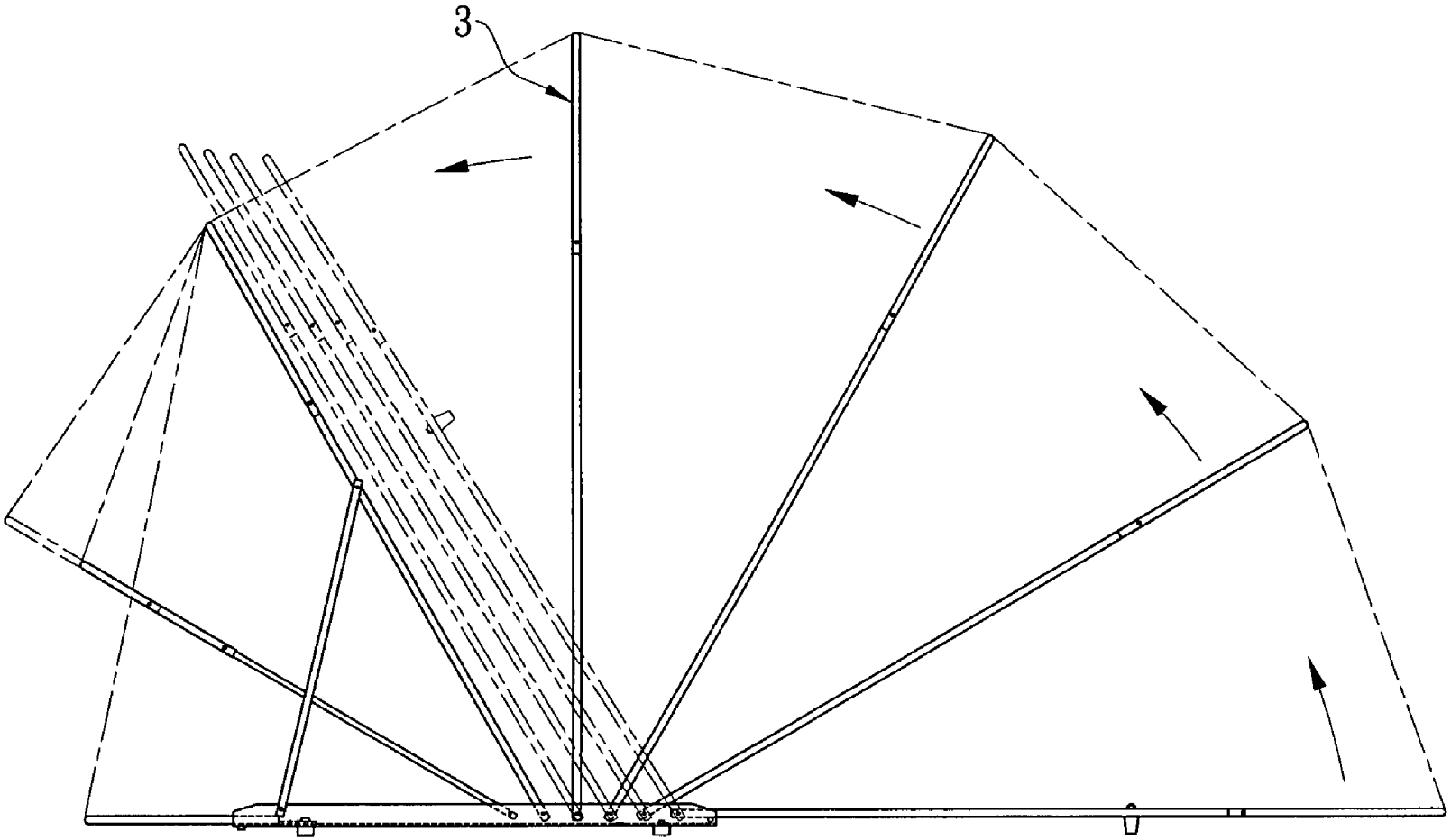
FIG. 4 shows a using state diagram showing that each support of the present invention is folded.
Figure 5:
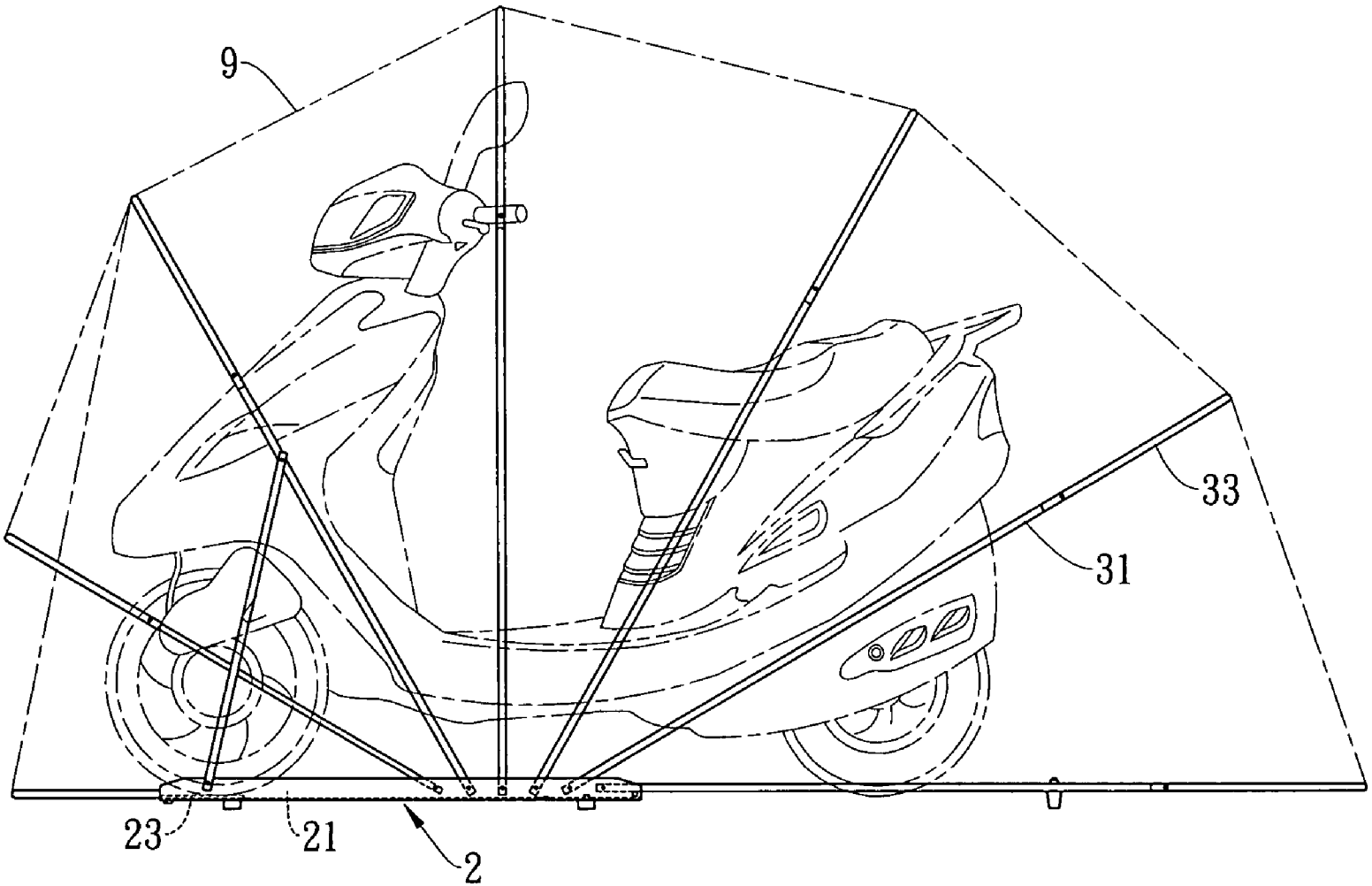
FIG. 5 shows a using state diagram showing that a motorcycle is parked in a cover of the present invention.

Please refer to FIG. 4 showing that each support 3 is folded for the convenience of incoming and outgoing of a motorcycle. As shown in FIG. 5, a motorcycle is parked in the cover 9. The stability of the present invention can be enhanced because the two ends of the bottom plate 23 are connected to the rear ends of the first and the second lateral plates 21, 22 respectively and the motion of the first and the second lateral plates 21, 22 can move other compartments of the present invention when the front wheel of the motorcycle is on the bottom plate 23 of the base 2.

Moreover, an extension tube (not shown in figures) can be provided between the first and the second support bars 31, 32 of each support and two ends of the arched support bar 33 for various types of motorcycles. Consequently, the total length of the first and the second support bars 31, 32 can be extended and the inner space of the cover 9 can be enlarged accordingly.

Figure 6:
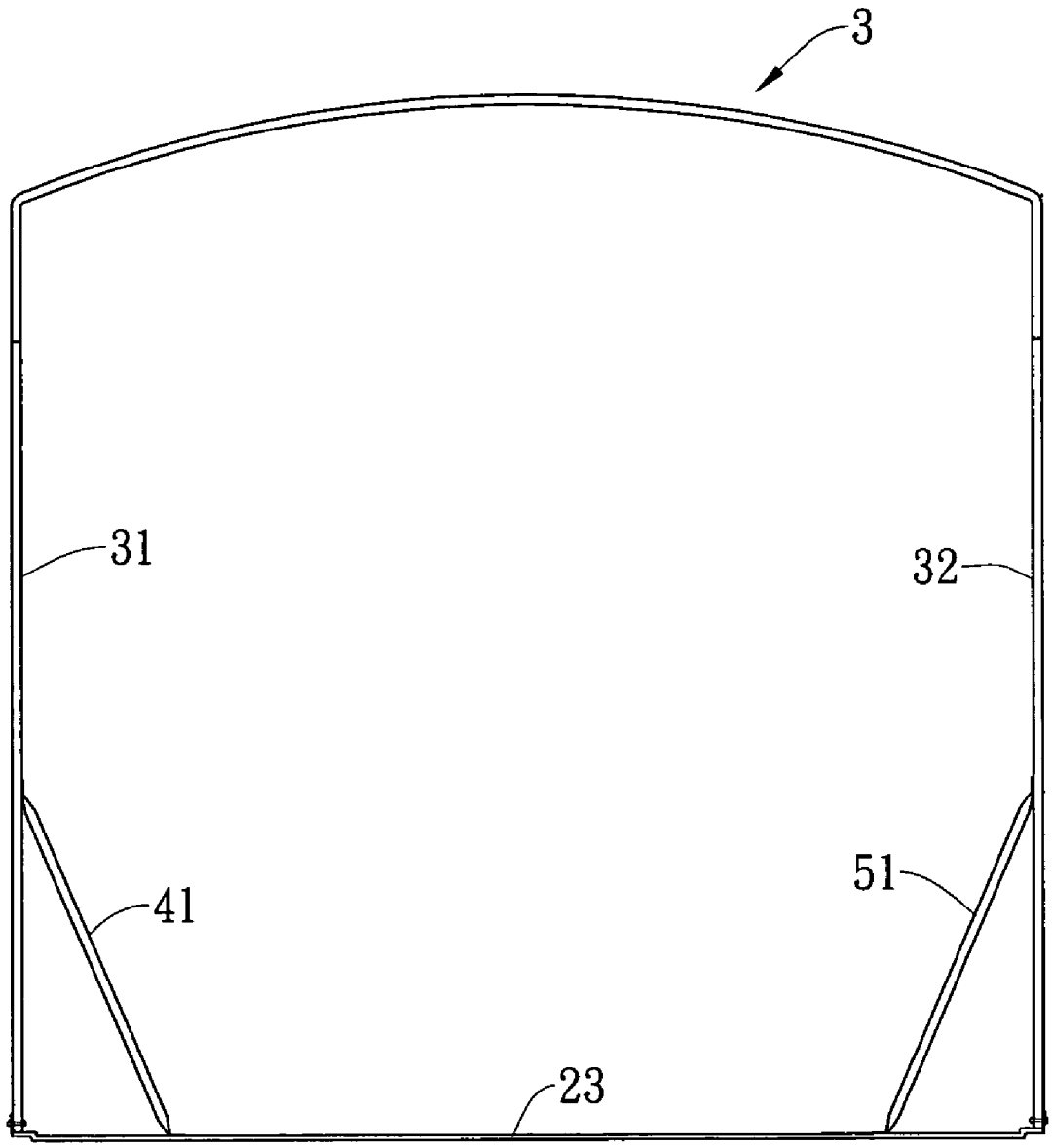
FIG. 6 shows a frontal view of another embodiment of the present invention where a third post and a fourth post are connected to a bottom plate and a support.

As shown in FIG. 6, in order to make the support 3 more firm to prevent the support 3 from being tilted by wind, a third post 41 and a fourth post 51 are further provided in another embodiment according to the present invention. The third and the fourth posts 41, 51 are long tubes. The tops of the third post 41 and the first post 4 are fixed to the same first support bar 31. The tops of the fourth post 51 and the second post 5 are fixed to the same second support bar 32. The bottom of the third post 41 is fixed to the top of one side of the bottom plate 23 while the bottom of the fourth post 51 is fixed to the top of another side of the bottom plate 23. By this way, the first and the second support bars 31, 32 are supported outwardly by the third and the fourth support posts 41, 51. Thereby, the support 3 can be supported firmly.

Figure 7:
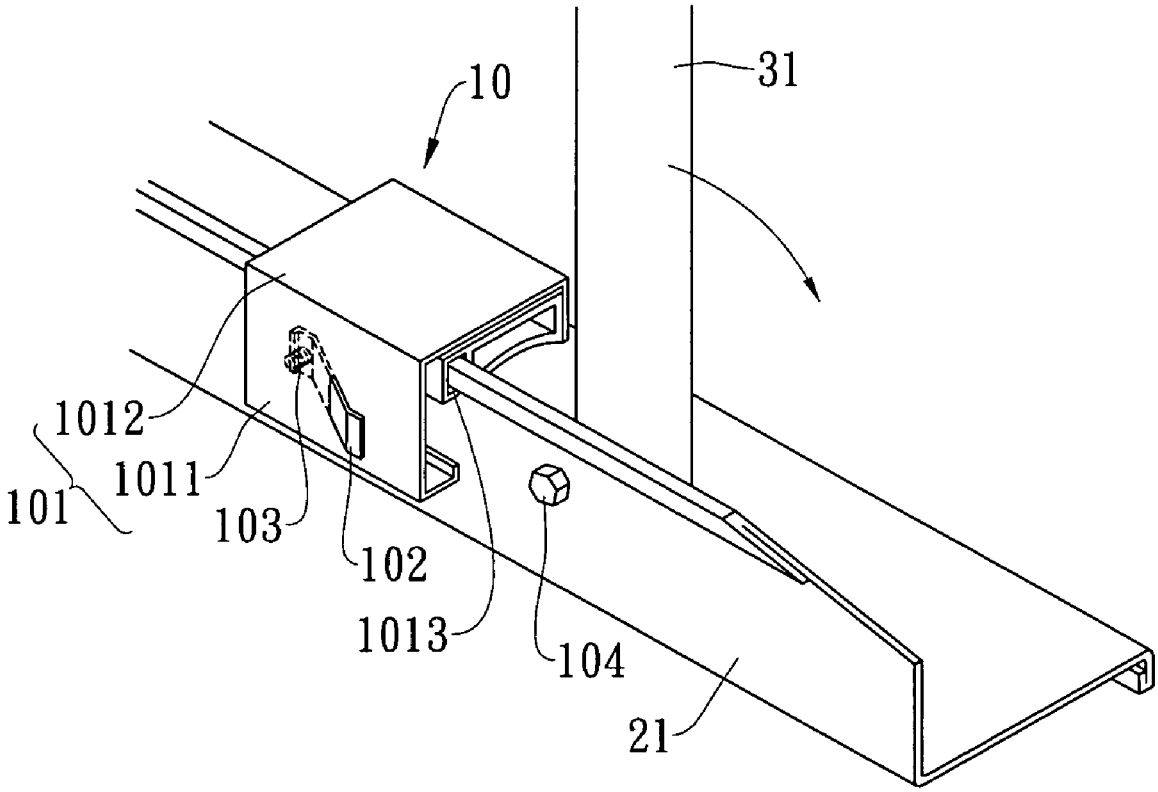
FIG. 7 shows a perspective view of another embodiment of the present invention where a positioning device is connected to a first lateral plate.

Please refer to FIG. 7 that shows another embodiment according to the present invention. In addition to the structure shown in the first embodiment, the present invention further has a positioning device 10 including a slidable element 101, a stop piece 102, and an elastic element 103.

The slidable element 101 is roughly in inversed-L shape and includes a vertical part 1011 and a transverse part 1012. The bottom of the vertical part 1011 is against the lateral side of the first lateral plate 21. The transverse part 1012 is provided with a channeled track 1013 that is in connection with the top of the first lateral plate 21, so that the slidable element 101 can be in slidable connection with the first lateral plate 21.

The stop piece 102 is pivotally connected to the vertical part 1011. Alternatively, the stop piece 102 can also extends through the vertical part 1011, that is, one end of the stop piece 102 protrudes from the lateral side of the vertical part 1011 while another end of the stop piece 102 protrudes from the medial side of the vertical part 1011. A spring can be used as the elastic element 103 and is disposed between the end of the stop piece 102 protruding from the medial side of the vertical part 1011 and the medial side of the vertical part 1011. Besides, the stop element 104 can be a screw and the first support bar 31 is pivotally connected to the first lateral plate 21 by a pivot that is formed from the screw.

Figure 8:
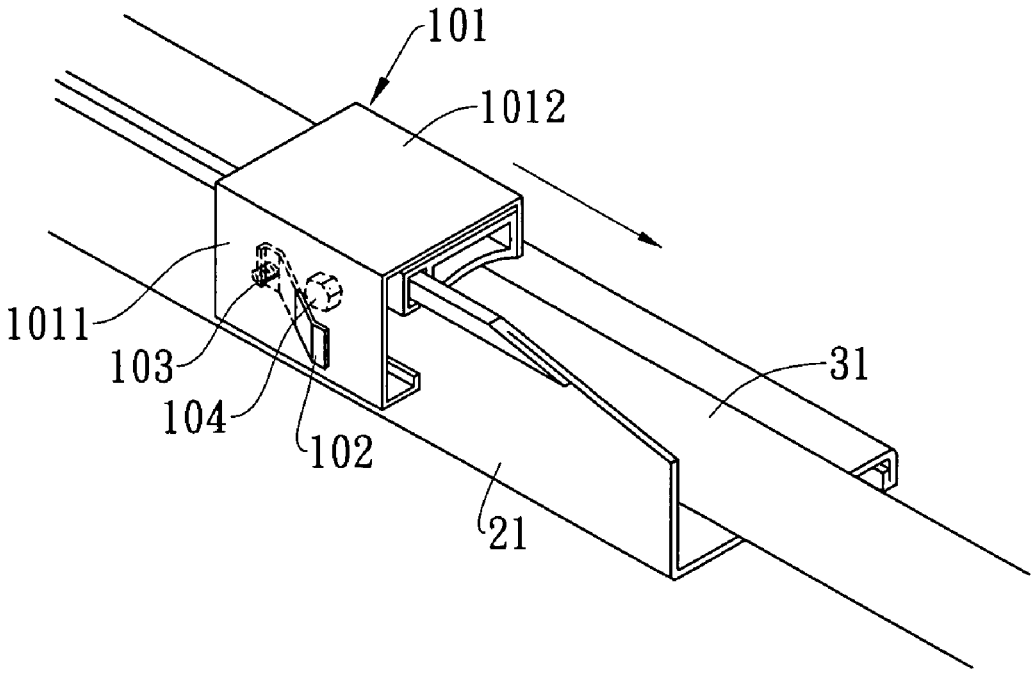
FIGS. 8 and 9 show another using state diagram of the present invention.
Figure 9:
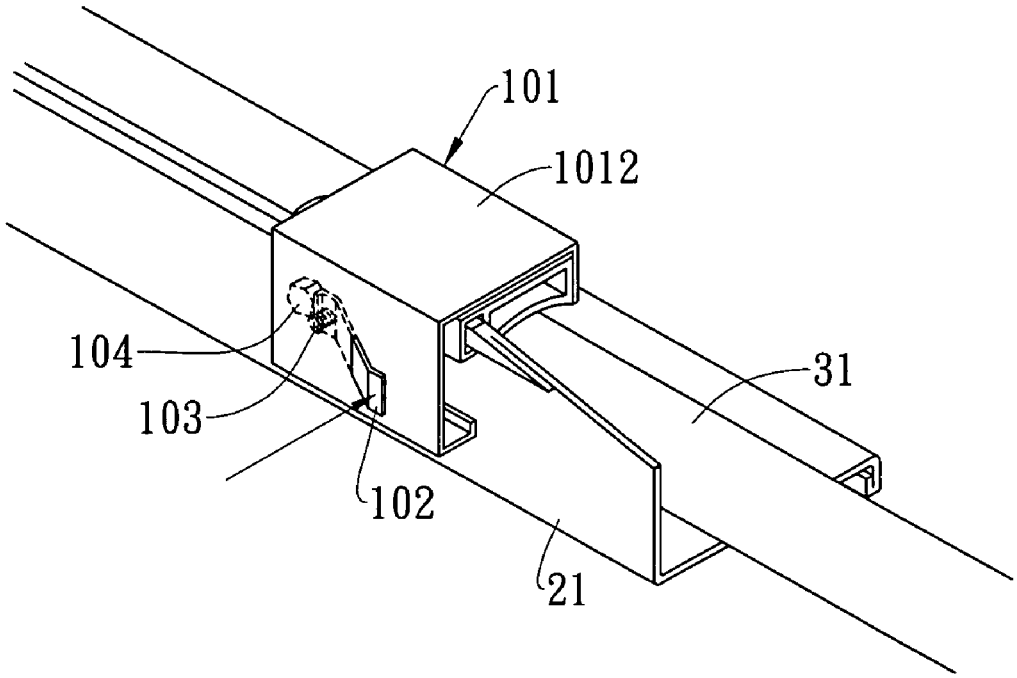

Please refer to FIG. 8. As shown in FIG. 8, when the first support bar 31 of one support 3, the one nearest the anterior end of the first lateral plate 21 among five supports, is turned downward onto the ground, users push the slidable element 101 forward to have the elastic element 103 compressed by another end of the stop piece 102 and to have another end of the stop piece 102 passed through the stop element 104. As shown in FIG. 9, when the elastic element 103 restores its original length, another end of the stop piece 102 can be limited at the anterior end of the stop element 104. Accordingly, the transverse part 1012 of the slidable element 101 can be against upper part of the first support bar 31, so that the first support bar 31 can be positioned. When users push the end of the stop piece 102 that protrudes from the lateral side of the vertical part 1011, the elastic element 104 will be pressed by another end of the stop piece 102 again, so that the slidable element 101 is moved backward and the first support bar 31 is relieved.

In practice, there are two positioning devices 10 used to position the first and the second support bars 31, 32 respectively.

Therefore, the present invention has the following advantages:

1. Because air can flow freely through the cover according to the present invention, the free flow of air can prevent high temperature within the cover and thus the lifetime of a motorcycle parked in the cover can be extended.
2. Because the extent of air convection between the inside and the outside of the cover can be adjusted flexibly according to the present invention, the air window can be opened to an approximate extent generally and closed when attacked by a typhoon to prevent from rain or blowing wind.
3. The inner side of the falling part is provided with an airflow circuit and the falling part is designed to tilt downward. Consequently, when users prop falling part and make the air window open, it is unnecessary to worry about the problem that rain is splashed into the cover when it rains heavily and accidentally.
4. The cover according to the present invention can be folded backward with the movement of each support and can be operated without touching the motorcycle parked therein, so that it is convenient to use and can prevent the cover from rubbing against the surface of the motorcycle.
5. Because the cover can be spaced apart from the motorcycle parked therein in a sufficient distance according to the present invention, the problem that the conventional automobile covers cannot be applied onto automobiles when the automobiles are parked outside in rainy days or when exhaust pipes of the automobiles are still at high temperature.
6. The positioning device of the present invention can be used to position the support bar of a support and prevent the displacement of the support caused by wind. Thereby, the cover can be kept stable to protect motorcycles placed therein effectively.

As disclosed in the above description and attached drawings, the present invention can provide an air-permeable simple car cover tent that is rainproof and foldable, and by using the simple car cover tent, the temperatures inside and outside the cover of the simple car cover tent can be regulated effectively. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. An air-permeable simple car cover tent, comprising:

a base, including a first lateral plate and a second plate that are parallel to each other;

a stop element provided on the first lateral plate;

a plurality of supports, where each support including a first support bar and a second support bar that are parallel to each other, and the bottoms of the first and the second support bars are pivotally connected to the first and the second lateral plates respectively;

a positioning device for positioning the first support bar including a slidable element, a stop piece, and an elastic element, in which the slidable element has a vertical part and a transverse part; the transverse part is provided with a track that is in slidable connection with the first lateral plate; the stop piece is pivotally provided at the vertical part and one end of the stop piece protrudes laterally from the vertical part while another end of the stop piece protrudes medially from the vertical part; the elastic element is provided between another end of the stop piece and the medial side of the vertical part;

a first support leg and a second support leg, where the bottom of the first support is pivotally connected to the first lateral plate while the bottom of the second support is pivotally connected to the second lateral plate; and a cover for covering the supports, where one end of the cover is provided with a falling part, two holes and at least an air window; the top of the falling part is connected with the cover and the tops of the first and the second support legs are inserted through the holes respectively and connected to the bottom of the falling part to prop the falling part open and air can flow through the cover.

2. The air-permeable simple car cover tent as claimed in claim 1, wherein the first lateral plate of the base is provided a plurality of horizontally arranged first holes while the second lateral plate is provided a plurality of horizontally arranged second holes, and the first and the second holes are for pivotal connection with bottoms of the first and the second support bars of each support respectively.

3. The air-permeable simple car cover tent as claimed in claim 1, wherein the base further includes a bottom plate and two ends of the bottom plate are connected with the first and the second lateral plates respectively; each cross section of the first and the second lateral plates is in L shape.

4. The air-permeable simple car cover tent as claimed in claim 3 further including a first post, a second post, a third post, and a fourth post, where the top of the first post is connected with one first support bar while the bottom thereof is connected with the first lateral plate; the top of the second post is connected with one second support bar while the bottom thereof is connected with the second lateral plate; the top of the third post is connected with one first support bar while the bottom thereof is connected to the top of one side of the bottom plate; the top of the fourth post is connected with one first support bar while the bottom thereof is connected to the top of another side of the bottom plate.

5. The air-permeable simple car cover tent as claimed in claim 1, wherein the support further includes an arched support bar and a rear support, where two ends of the support bar are connected with the parallel first and the second support bars respectively; the arched support bar is in inverse U shape; the rear support is in connection with the rear part of the base.

6. The air-permeable simple car cover tent as claimed in claim 1 further including an arched support leg and two ends thereof are in telescopic connection with the first and the second support legs respectively.

* * * * *